US010541491B2

(12) United States Patent
Li et al.

(10) Patent No.: US 10,541,491 B2
(45) Date of Patent: Jan. 21, 2020

(54) ELECTRICAL CONNECTOR

(71) Applicant: Molex, LLC, Lisle, IL (US)

(72) Inventors: Yue-You Li, Dongguan (CN); Xiao-An Wang, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/654,902

(22) Filed: Jul. 20, 2017

(65) Prior Publication Data

US 2018/0131121 A1 May 10, 2018

(30) Foreign Application Priority Data

Jul. 22, 2016 (CN) ..... 2016 1 0586061

(51) Int. Cl.
*H01R 13/506* (2006.01)

(52) U.S. Cl.
CPC ..... *H01R 13/506* (2013.01)

(58) Field of Classification Search
CPC ..... H01R 13/443; H01R 13/506; H01R 13/6271–6273; H01R 13/44; H01R 13/447
See application file for complete search history.

(56) References Cited

U.S. PATENT DOCUMENTS 2,428,323 A * 9/1947 Winer ..... H01R 13/443 174/77 R
3,182,280 A * 5/1965 Daut ..... H01R 13/443 439/148
4,197,945 A * 4/1980 Sherwood ..... H01R 13/447 174/138 F
4,258,970 A * 3/1981 Bourdon ..... H01R 13/443 439/148
4,731,032 A * 3/1988 Noorily ..... H01R 13/443 439/136
4,871,320 A 10/1989 Mouissie
5,026,295 A * 6/1991 Fong ..... H01R 13/5213 439/135
5,215,474 A * 6/1993 Rotella ..... H01R 13/6485 361/220

(Continued)

FOREIGN PATENT DOCUMENTS

CN 101347060 A 1/2009
CN 203014024 U 6/2013

(Continued)

OTHER PUBLICATIONS

Decision of Refusal received for Japanese Patent Application No. 2017-116034, dated Dec. 18, 2018, 6 pages. (3 pages of English Translation and 3 pages of Official Copy).

*Primary Examiner* — Oscar C Jimenez
(74) *Attorney, Agent, or Firm* — Molex, LLC

(57) ABSTRACT

A connector assembly is provided which includes a first connector having a first housing and a second connector having a second housing. The first housing has two fixed portions positioned apart from one another in the transverse direction, an elastic portion passing between the two fixed portions and able to bend elastically in the longitudinal direction, and an engaging protruding portion formed on the elastic portion and able to be hooked in an engaging hole in the second housing. The engaging protruding portion is positioned between upper and lower edges of the elastic portion.

8 Claims, 4 Drawing Sheets

(56) References Cited

U.S. PATENT DOCUMENTS 5,242,311 A * 9/1993 Seong ..... H01R 13/443 439/135
5,711,681 A * 1/1998 Hasegawa ..... H01R 31/08 439/507
6,019,617 A * 2/2000 Liu ..... H01R 13/447 439/135
6,755,672 B2 * 6/2004 Lai ..... H01R 13/44 174/138 F
6,821,161 B1 * 11/2004 Cao ..... H01R 13/506 439/701
7,384,288 B2 * 6/2008 Sano ..... H01R 13/6585 439/189
7,722,413 B2 * 5/2010 Tonosaki ..... H01R 13/41 439/733.1
7,946,880 B2 * 5/2011 Tsai ..... H01R 13/506 439/358
2002/0013076 A1 * 1/2002 Akeda ..... G02B 6/3849 439/135
2005/0181653 A1 * 8/2005 Shimizu ..... H01R 13/6273 439/310
2010/0240238 A1 * 9/2010 Hattori ..... H01R 13/5213 439/135
2013/0321998 A1 12/2013 Han et al.
2014/0118891 A1 * 5/2014 Crane ..... H01R 13/443 361/657
2016/0093970 A1 * 3/2016 Wu ..... H01R 13/443 439/148
2016/0248199 A1 * 8/2016 Schrader ..... H01R 13/6273

FOREIGN PATENT DOCUMENTS

CN 203039141 U 7/2013
CN 203312550 U 11/2013
CN 103457075 A 12/2013
CN 203536597 U 4/2014
CN 205039282 U 2/2016
JP 59-149389 U1 10/1984
JP H06-36239 U 5/1994
JP 2008-091117 A 4/2008
JP 2013-254696 A 12/2013

* cited by examiner

ELECTRICAL CONNECTOR

RELATED APPLICATIONS

This application claims priority to Chinese Application No. 201610586061.X, filed Jul. 22, 2016, which is incorporated herein by reference in its entirety.

TECHNICAL FIELD

The present disclosure relates to an electrical connector.

BACKGROUND ART

A common electrical connector typically comprises a plurality of pins, due to the larger number of pins, in manufacturing, transportation and assembling processes, if the pins are exposed outside and lack protection, the pins are prone to deform or break by collision, which will affect the connecting effect and shorten the service life of the connector. Thus, it needs to provide a protection structure for the pins.

For example, an electrical connector is provided in Chinese Patent publication No. CN103457075 A. Referring to FIG. 1, this patent discloses a connector 300 provided with a plurality of pin 302, the connector 300 is mounted on a circuit board 400. The connector 300 further comprises a connector protection cover 100 for protecting the pins 302. The connector protection cover 100 comprises a rectangle installation block 120 which is provided with four positioning holes 122 for insertion of a part of the pins 302 and a receiving slot 124 receiving the other part of pins 302. While this technical solution can provide protection for the pins 302, the interference fit is used between the pin 302 and the positioning hole 122 so that the connector protection cover 100 can be held on the connector 300, therefore, the part of the pins 302 will be squeezed by the positioning holes 122 and the corresponding risk of deformation occurs when the connector protection cover 100 is mounted onto the connector 300.

Therefore, it is necessary to develop an electrical connector which can avoid the above problem in the prior art.

SUMMARY

An object of the present disclosure is to provide an electrical connector which can not only protect pins of the electrical connector but also can be easily assembled and reliably held.

As reflected and broadly described herein, in order to achieve these and other advantages and in accordance with the object of the present disclosure, the present disclosure provides an electrical connector, the electrical connector comprises: a first housing provided with at least one pin; and a second housing detachably assembled to the first housing. The second housing is provided with: at least one pin receiving hole corresponding to the at least one pin in position and used to receive the at least one pin with clearance fit; and a latch which can be unlocked, the latch being latched with the first housing.

In an embodiment, the first housing is provided with a lock member, the second housing is provided with a lock member receiving portion corresponding to the lock member, the lock member receiving portion is used to receive the lock member but is not locked with the lock member.

In an embodiment, each lock member receiving portion may have a lateral opening.

In an embodiment, the pin receiving hole may have a shape which is large at both ends and narrow in a middle in an axial direction.

In an embodiment, the latch may be provided as two or more in number which are respectively positioned at both sides of the second housing or are positioned at the same side of the second housing.

In an embodiment, the latch may comprise a latching portion which is positioned at one end of the latch and is latched with an engaging portion of the first housing.

In an embodiment, the engaging portion may be an edge portion of the first housing or a protruding portion or a recessed portion positioned on the first housing.

In an embodiment, the latch may comprise a releasing press portion at the other end of the latch opposite to the latching portion, and the latching portion is detached from the engaging portion of the first housing when the releasing press portion is pressed.

In an embodiment, the latch may comprise a middle portion positioned between the latching portion and the releasing press portion, the middle portion is integrally connected to the second housing.

The beneficial effect of the present disclosure lies in that: the electrical connector according to the present disclosure not only can protect the pins and the lock member which are provided therein from being collided and deformed in the manufacturing and transportation process, but also because the second housing of the electrical connector has a latch thereon, which makes the assembling and detaching operation between the second housing and the first housing easy, and which makes the latching state stable so that it will not appear too tight or too loose condition, and after detachment, it will not damage the latch on the second housing, so that the second housing can be used repeatedly.

The above and other objects, features, aspects and advantages of the present disclosure will become more apparent by the following detailed description of the present disclosure in combination with the accompanying figures.

BRIEF DESCRIPTION OF THE DRAWINGS

The Figures are included in the present disclosure to provide a further understand for the present disclosure, and are incorporated in the specification and constitute a part of the present specification, the Figures illustrate embodiments of the present disclosure and explain the concept of the present disclosure together with the following detailed description.

DETAILED DESCRIPTION OF THE PREFERRED EMBODIMENTS

The present disclosure will be described in detail in combination with the accompanying Figures.

Figure 5A:
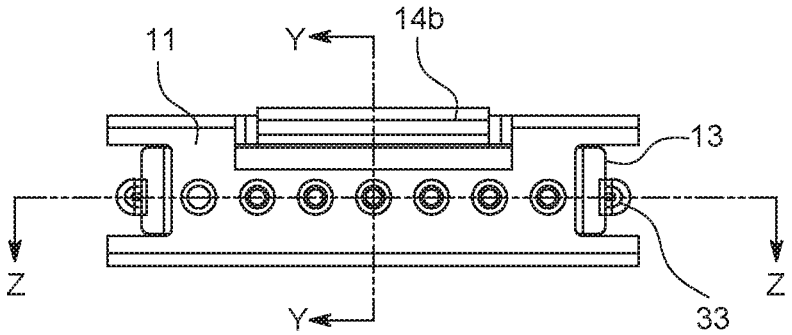
FIG. 5A is a top view of the electrical connector according to the present disclosure after assembled.
Figure 5B:
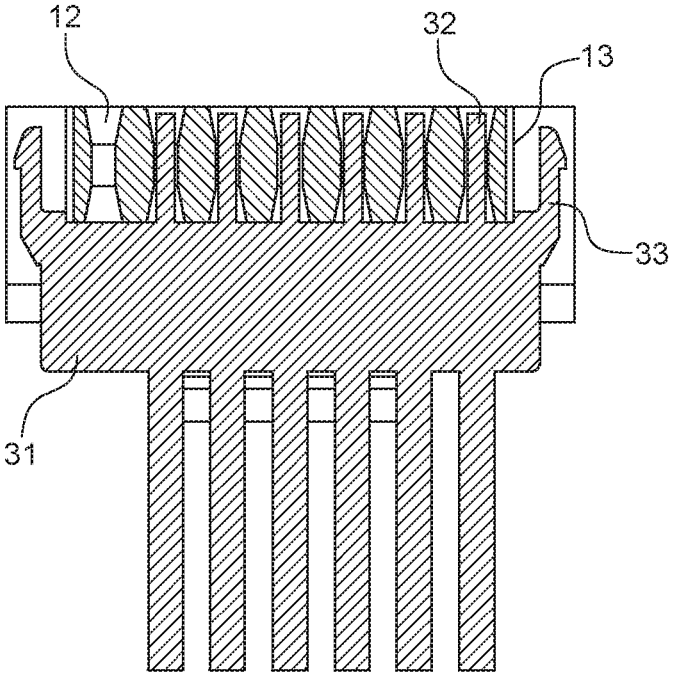
FIG. 5B is a cross-sectional view taken along a line 'Z-Z' of FIG. 5A.
Figure 5C:
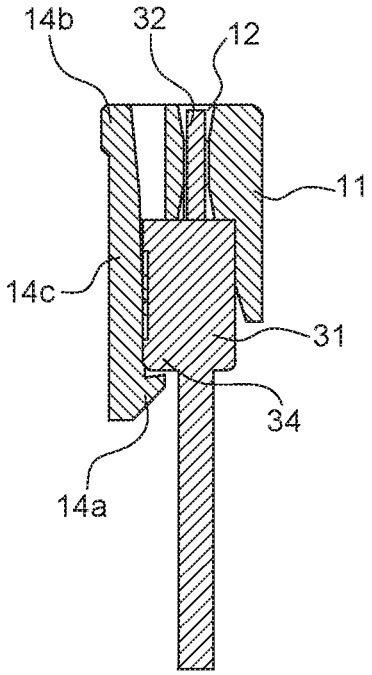
FIG. 5C is a cross-sectional view taken along a line 'Y-Y' of FIG. 5A.

An electrical connector according to the present disclosure comprises a first housing 31 provided with at least one pin 32 and a second housing 11 detachably assembled with the first housing 31. And, the second housing 11 is provided with at least one pin receiving hole 12 corresponding to the at least one pin 32 in position and used to receive the at least one pin 32 with clearance fit, so as to protect each pin 32 from being collided and damaged. As best shown in FIG. 5A, FIG. 5B and FIG. 5C, a radial size of each pin receiving hole 12 is larger than a radial size of the corresponding pin 32, so that after the second housing 11 is assembled with the first housing 31, a state between the pin receiving hole 12 and the pin 32 is in clearance fit. That is, when the second housing 11 is assembled to the first housing 31, due to the size difference between the pin receiving hole 12 and the pin 32, the fit between the pin receiving hole 12 and the pin 32 is very loose, which ensures that each pin 32 will not be deformed by squeezing. But it should be understood that, in other embodiments, each pin 32 and each pin receiving hole 12 are not limited to those shown in the figures in shape, construction and size, for example they are not limited to cylindrical in shape, they can be set according to actual demand as long as the pin receiving hole 12 can receive the pin 32 with the configuration of clearance fit, all those embodiments are contained in the protective scope of the present disclosure.

Figure 1:
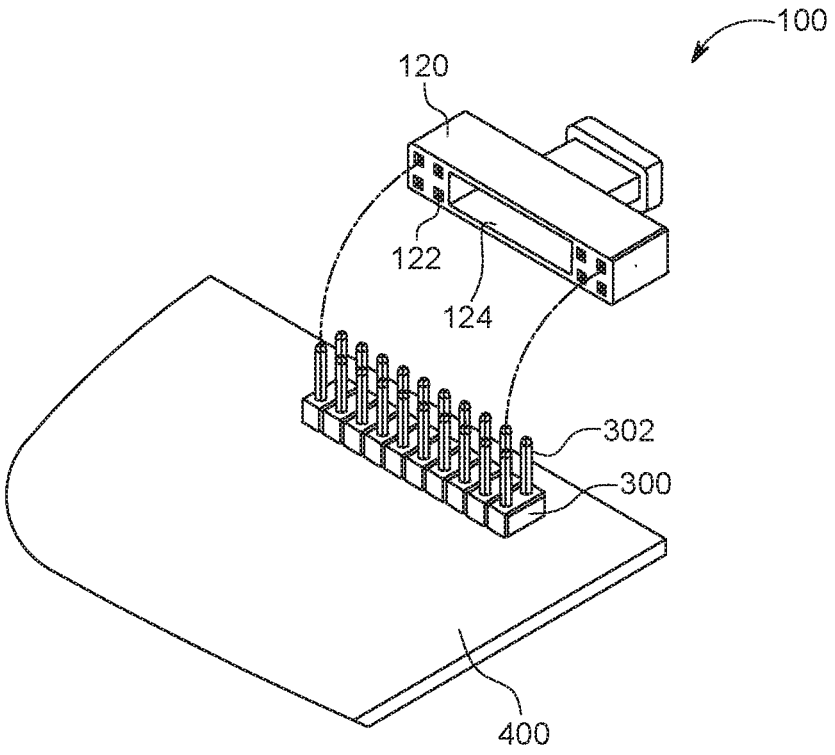
FIG. 1 is a schematic view of an electrical connector of the prior art.
Figure 2:
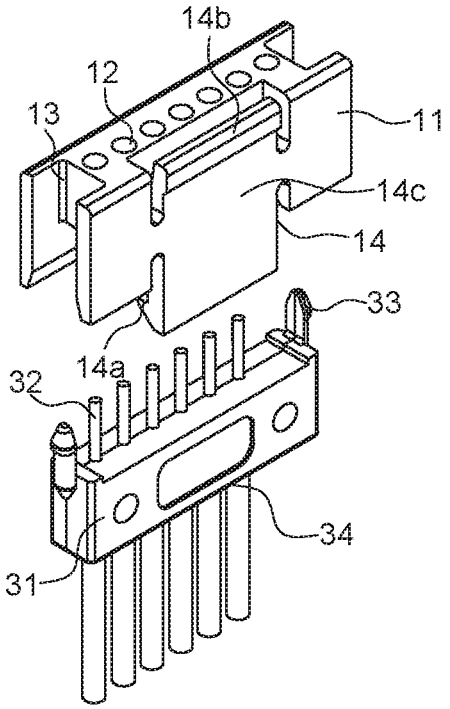
FIG. 2 is a perspective view of an electrical connector according to the present disclosure before assembled.
Figure 3:
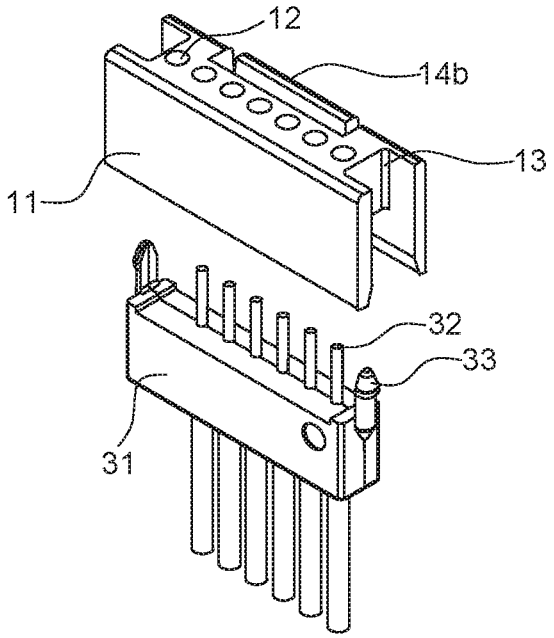
FIG. 3 is a perspective view of the electrical connector according to the present disclosure before assembled from another angle.
Figure 4:
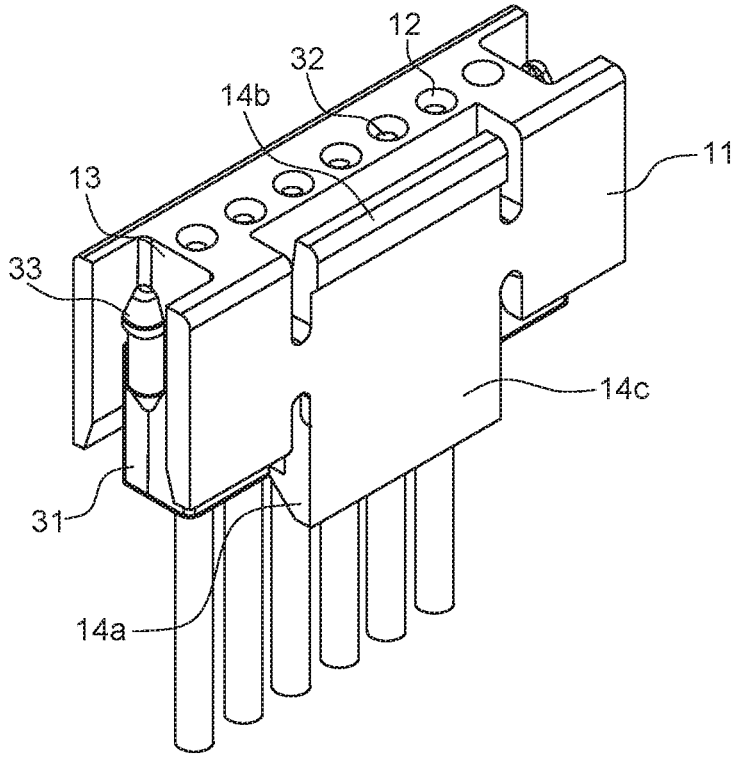
FIG. 4 is a perspective view of the electrical connector according to the present disclosure after assembled.

As shown in FIGS. 2-4, the number of pins 32 is six, the number of pin receiving holes 12 is seven, and each pin 32 corresponds to one pin receiving hole 12. But it should be understood that, in other embodiments, the number of the pins 32 can be set according to actual demand, while the number of the pin receiving holes 12 may be the same as the number of pins 32 or more than the number of pins 32, or the pin receiving holes 12 can be formed as an integral hole which receives all or part of the pins 32. These embodiments are contained in the protective scope of the present disclosure.

The second housing 11 is further provided with a latch 14 which can be unlocked, the latch 14 can be latched with the first housing 31 so as to ensure that the first housing 31 and the second housing 11 can be reliably held together without accidental detachment after the second housing 11 is assembled to the first housing 31.

In the specific embodiment shown in the Figures, the latch 14 comprises a latching portion 14*a*, a releasing press portion 14*b* and a middle portion 14*c*. The latching portion 14*a*, which may be a hook in shape, is positioned at one end of the latch 14 to latch onto an engaging portion 34 of the first housing 31. The releasing press portion 14*b* is positioned at the other end of the latch 14 opposite to the latching portion 14*a*, the middle portion 14*c* is positioned between the latching portion 14*a* and the releasing press portion 14*b*. When the press release portion 14*b* is pressed inwardly, the middle portion 14*c* acts as a pivot point, and under the lever principle, the latching portion 14*a* will be moved outwardly and then is detached from the engage portion 34 of the first housing 31.

In the embodiment, the engaging portion 34 is an edge portion of the first housing 31. However, it should be understood that the first housing 31 can be provided with a protruding portion or a recessed portion as the engage portion 34 to engage with the latching portion 14*a* in other embodiments.

As shown in FIG. 2 and FIG. 4, the latch 14 and the second housing 11 are integrally formed, that is, the middle portion 14*c* of the latch 14 is integrally connected to the second housing 11. But it should be understood that the latch 14 can be a separate component in other embodiments.

In addition, in the embodiment shown in FIG. 2, the latch 14 is provide as only one in number and is positioned at one side of the second housing 11. However, it should be understood that the latch 14 can be provided as two or more in number which are respectively at both sides of the second housing 11 or which are positioned at the same side of the second housing 11 side by side, thereby more reliably holding the second housing 11 and the first housing 31 together.

In the embodiment, the first housing 31 is further provided with a lock member 33, the lock member 33 is used to lock the electrical connector and another matching connector or other mechanism together when the electrical connector is connected to another matching connector or other mechanism. In this case, the second housing 11 is further provided with a lock member receiving portion 13 corresponding to the lock member 33 of the first housing 31, the lock member receiving portion 13 is used to receive the lock member 33 but is not locked with the lock member 33. Since the lock member receiving portion 13 is not locked with the lock member 33, the second housing 11 can be easily assembled to the first housing 31 and easily detached from the first housing 31, and the lock member 33 is not damaged in this process.

In addition, as shown in FIGS. 2-4, the lock member receiving portion 13 has a lateral opening so as to form a groove-like structure. However, it should be understood that the lock member receiving portion 13 may not have the lateral opening but may be in form of through-hole in other embodiments.

As best shown in FIG. 5B and FIG. 5C, in the case that each pin 32 corresponds to one pin receiving hole 12, each pin receiving hole 12 has a shape which is large at both ends and narrow in a middle in an axial direction, so when the second housing 11 is assembled to the first housing 31, the pin receiving hole 12 can better guide the pin 32 to enter into the pin receiving hole 12. The present disclosure is not limited to this, and the pin receiving hole 12 may also be a standard cylindrical hole or other suitable shape.

The foregoing embodiment and advantages are merely exemplary and cannot be deemed as limiting the present disclosure. The description herein is intended to illustrate examples, and not to limit the scope of the claims. Various alternatives, variations and modifications will be apparent to those skilled in the art. The features, structures, methods, and other characteristics of the exemplary embodiments described herein may be combined in a variety of ways to obtain other and/or alternative exemplary embodiments.

The features of the present disclosure may be embodied in many forms without departing from the spirit of the present disclosure, and it should be understood that the above embodiments are not limited to any detail described above, unless otherwise indicated, and are broadly construed to be within the scope defined by the appended claims, and thus all modifications and variations of the equivalent solutions which are fallen within the scope and boundary of the claims should be covered by the appended claims.

The invention claimed is:

1. An electrical connector, comprising:

a first housing provided with at least one pin; and a second housing detachably assembled to the first housing, the second housing being provided with:

at least one pin receiving hole corresponding to the at least one pin in position and used to receive the at least one pin with clearance fit; and a latch which can be unlocked, the latch being latched with the first housing, wherein the first housing is provided with a lock member configured to lock the electrical connector to a mating electrical connector, the second housing is provided with a lock member receiving portion corresponding to the lock member, the lock member receiving portion is configured to receive the lock member but not lock with the lock member either during or after the lock member is received by the lock member receiving portion.

2. The electrical connector of claim 1, wherein the lock member receiving portion has a lateral opening.

3. The electrical connector of claim 1, wherein the pin receiving hole has a shape which is large at both ends and narrow in a middle in an axial direction.

4. The electrical connector of claim 1, wherein the latch is provided as two or more in number which are respectively positioned at both sides of the second housing or are positioned at the same side of the second housing.

5. The electrical connector of claim 1, wherein the latch comprises a latching portion which is positioned at one end of the latch and is latched with an engaging portion of the first housing.

6. The electrical connector of claim 5, wherein the engaging portion is an edge portion of the first housing or a protruding portion or a recessed portion positioned on the first housing.

7. The electrical connector of claim 5, wherein the latch comprises a releasing press portion at the other end of the latch opposite to the latching portion, and the latching portion is detached from the engaging portion of the first housing when the releasing press portion is pressed.

8. The electrical connector of claim 7, wherein the latch comprises a middle portion positioned between the latching portion and the releasing press portion, the middle portion is integrally connected to the second housing.

* * * * *